US010207883B2

(12) United States Patent
Inoue

(10) Patent No.: US 10,207,883 B2
(45) Date of Patent: Feb. 19, 2019

(54) SHEET CONVEYANCE APPARATUS AND IMAGE FORMING APPARATUS

(71) Applicant: CANON KABUSHIKI KAISHA, Tokyo (JP)

(72) Inventor: Kozo Inoue, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/251,161

(22) Filed: Aug. 30, 2016

(65) Prior Publication Data

US 2017/0066609 A1 Mar. 9, 2017

(30) Foreign Application Priority Data

Sep. 8, 2015 (JP) ..... 2015-176458

(51) Int. Cl.
*B65H 5/02* (2006.01)
*B65H 5/38* (2006.01)
(Continued)

(52) U.S. Cl.
CPC ..... *B65H 5/38* (2013.01); *B65H 5/26* (2013.01); *G03G 15/65* (2013.01);
(Continued)

(58) Field of Classification Search
CPC .. B65H 5/38; B65H 2402/45; B65H 2404/61; B65H 2404/6111
See application file for complete search history.

(56) References Cited

U.S. PATENT DOCUMENTS 5,052,670 A * 10/1991 Makiura ..... G03G 15/234 271/127
7,448,621 B2 * 11/2008 Yasumoto ..... G03G 15/6529 271/264
(Continued)

FOREIGN PATENT DOCUMENTS

CN 1712341 A 12/2005
CN 1912763 A 2/2007
(Continued)

OTHER PUBLICATIONS

European Search Report issued in corresponding EP Application No. 16185685.1 dated Jan. 30, 2017.
(Continued)

*Primary Examiner* — Howard J Sanders
(74) *Attorney, Agent, or Firm* — Venable LLP

(57) ABSTRACT

A sheet conveyance apparatus includes first and second conveyance paths that eventually merge together. A guide member pair constituting the first conveyance path includes a second path guide member disposed on the second conveyance path side among the guide member pair and having a straight portion and a curved portion provided continuously downstream of the straight portion. A downstream end portion of the guide member is positioned in a merging portion of the first and second conveyance paths. The straight portion includes a plurality of ribs and a slope portion formed thereon. The plurality of ribs project perpendicularly from a base portion and are parallel to the sheet conveyance direction. The slope portion is provided between two of the plurality of ribs adjacent to each other and is inclined from the base portion toward the ridges of the plurality of ribs.

12 Claims, 5 Drawing Sheets

(51) Int. Cl.
*G03G 15/00* (2006.01)
*B65H 5/26* (2006.01)

(52) U.S. Cl.
CPC ..... *B65H 2402/45* (2013.01); *B65H 2404/61* (2013.01); *B65H 2404/6111* (2013.01); *B65H 2801/06* (2013.01)

(56) References Cited

U.S. PATENT DOCUMENTS

| | | | | |
|---|---|---|---|---|
| 7,748,697 | B2 | 7/2010 | Fujita et al. | |
| 7,871,075 | B2 | 1/2011 | Ksaba | |
| 8,177,216 | B2 | 5/2012 | Watase et al. | |
| 8,459,635 | B2 | 6/2013 | Inoue | |
| 8,485,516 | B2 | 7/2013 | Watase et al. | |
| 8,515,309 | B2 | 8/2013 | Takagi et al. | |
| 8,876,109 | B2 | 11/2014 | Kitamura | |
| 9,272,861 | B2 | 3/2016 | Tateishi et al. | |
| 9,365,362 | B2 | 6/2016 | Aoki | |
| 9,851,676 | B2 * | 12/2017 | Yamaguchi | B65H 5/36 |
| 2003/0042665 | A1 | 3/2003 | Ferrarese et al. | |
| 2006/0076729 | A1 * | 4/2006 | Kozaki | B65H 29/60 271/9.11 |
| 2011/0115149 | A1 | 5/2011 | Imai | |
| 2015/0068865 | A1 | 3/2015 | Akatsuka | |
| 2015/0084265 | A1 | 3/2015 | Kawashima | |
| 2015/0259166 | A1 * | 9/2015 | Wakakusa | B65H 5/26 271/3.19 |
| 2016/0289024 | A1 * | 10/2016 | Morizono | B65H 5/062 |

FOREIGN PATENT DOCUMENTS

| | | | |
|---|---|---|---|
| CN | 101254866 | A | 9/2008 |
| CN | 102109796 | A | 6/2011 |
| CN | 103873716 | A | 6/2014 |
| JP | 2005-314108 | A | 11/2005 |
| JP | 2015-147672 | A | 8/2015 |

OTHER PUBLICATIONS

Chinese Office Action dated Jul. 27, 2018, in related Chinese Patent Application No. 201610808753.4 (with English translation).

* cited by examiner

SHEET CONVEYANCE APPARATUS AND IMAGE FORMING APPARATUS

BACKGROUND OF THE INVENTION

Field of the Invention

The present invention relates to a sheet conveyance apparatus and an image forming apparatus.

Description of the Related Art

Conventionally, an image forming apparatus such as a facsimile apparatus, a copying machine, and a printer includes a sheet conveyance apparatus that conveys a sheet fed from a sheet feed cassette or a manual feed tray to an image forming unit. The sheet conveyance apparatus include a sheet conveyance path for conveying the sheet fed from the sheet feed cassette, a sheet conveyance path for conveying the sheet fed from the manual feed tray, and a merging path formed by these sheet conveyance paths merging with each together. In forming an image, the sheet having passed through one of the sheet conveyance paths is conveyed to the merging path and then to the image forming unit.

As an example of the sheet conveyance apparatus including such a merging path, US2015/0068865 discloses a sheet conveyance apparatus in which a guide member forming a sheet conveyance path is provided with a conveyance rib for the purpose of reducing a drag in conveyance.

In such sheet conveyance apparatus, there is a case where a sheet conveyance path for conveying a sheet fed from a sheet feed cassette to an image forming unit is curved. In this case, in order to stably convey a sheet from the curved sheet conveyance path to a merging path without getting caught or else, it is required to position a distal end portion, i.e., a downstream end portion in a sheet conveyance direction of a guide member forming the curved sheet conveyance path, at a merging portion where the sheet conveyance paths merge together.

However, if the distal end portion of the guide member to be positioned at the merging portion is thick, there needs to be a large space at the merging portion and therefore the sheet conveyance apparatus is inevitably enlarged. In other words, if the distal end portion of the guide member is positioned at the merging portion so as to stably convey the sheet through the merging path, the sheet conveyance apparatus ends up being enlarged.

SUMMARY OF THE INVENTION

According to an aspect of the present invention, a sheet conveyance apparatus includes a first conveyance path whose downstream portion in a sheet conveyance direction is curved, the first conveyance path comprising a guide member pair, and a second conveyance path configured to merge with the first conveyance path at a merging portion. The guide member pair includes a second path side guide member disposed on a side of the second conveyance path among the guide member pair. The second path side guide member includes a straight portion extending straightly, and a curved portion being provided downstream, in the sheet conveyance direction, of the straight portion so as to be continuous with the straight portion. A downstream end portion, in the sheet conveyance direction, of the second path side guide member is positioned at the merging portion. The straight portion includes a plurality of ribs, a base portion, and a slope portion, the plurality of ribs projecting from the base portion and to be parallel to the sheet conveyance direction, the slope portion being provided between two of the plurality of ribs adjacent to each other in a width direction orthogonal to the sheet conveyance direction and being inclined in such a manner that the slope portion approaches from the base portion to ridges of the ribs as it approaches the downstream side in the sheet conveyance direction.

Further features of the present invention will become apparent from the following description of exemplary embodiments with reference to the attached drawings.

DESCRIPTION OF THE EMBODIMENTS

Figure 1:
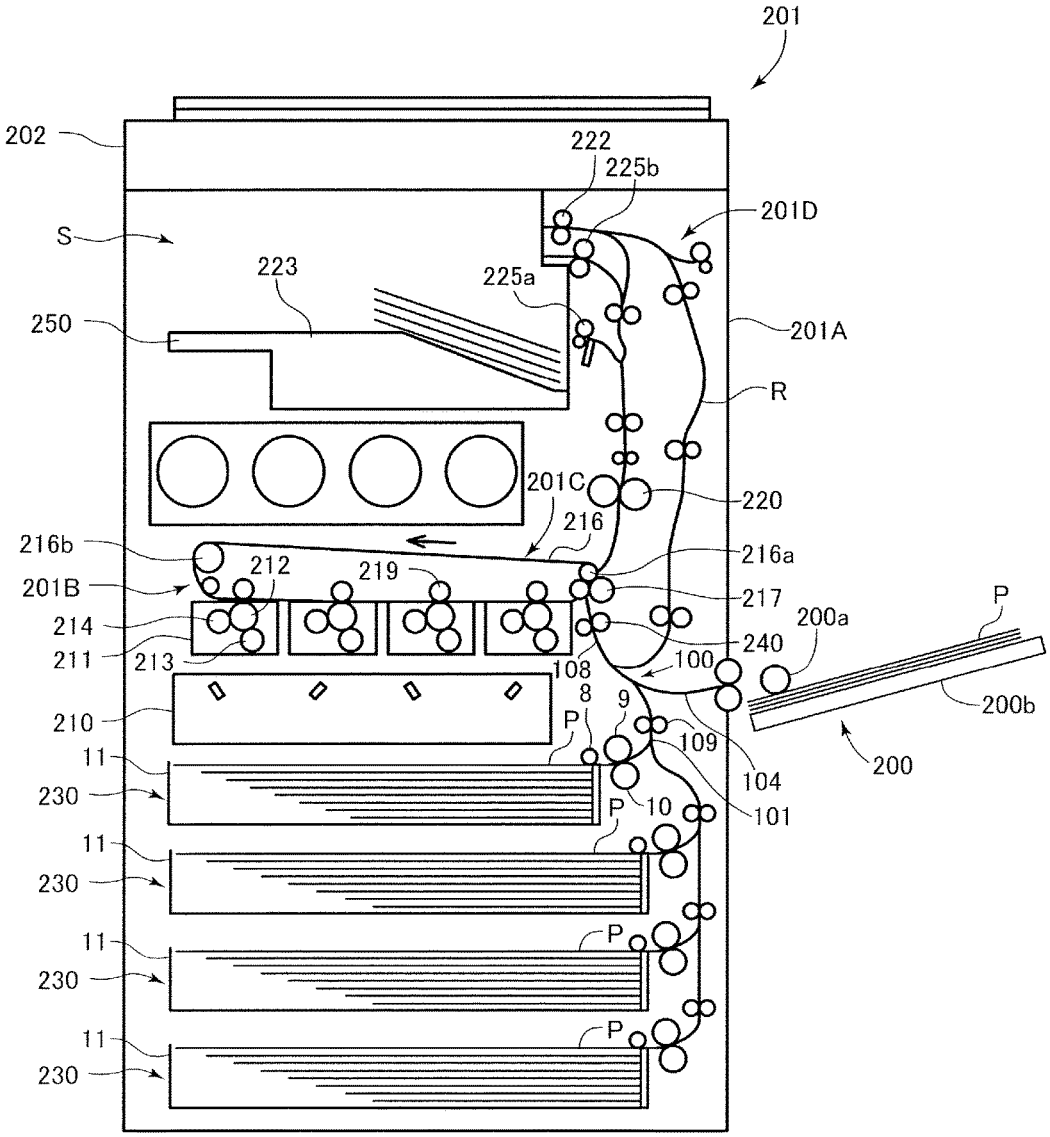
FIG. 1 schematically illustrates a configuration of a color laser printer, i.e., an exemplary image forming apparatus including a sheet conveyance apparatus according to an exemplary embodiment of the present invention.

An exemplary embodiments of the present invention will be described in detail below with reference to the drawings. FIG. 1 illustrates an overall configuration of a full-color laser beam printer, i.e., an exemplary image forming apparatus including a sheet conveyance apparatus according to the exemplary embodiment.

As illustrated in FIG. 1, the full-color laser beam printer 201 includes a printer body 201A and an image forming unit 201B. The full-color laser beam printer 201 will be referred to as a printer 201 hereinafter. The printer body 201A is a body of the image forming apparatus. The image forming unit 201B is provided in the printer body 201A and is configured to form an image on a sheet. In addition, an image reading unit 202 serving as an upper device is disposed in an upper part of the printer body 201A so as to be approximately horizontal, and a discharge space S to which sheets are to be discharged is defined between the image reading unit 202 and the printer body 201A.

Sheet feeders 230 each configured to feed a sheet P from a sheet feed cassette 11 are provided in a lower part of the printer body 201A, and a manual feeder 200 including a manual feed tray 200*b* to which a sheet can be manually fed is provided on one side of the printer body 201A. A sheet conveyance apparatus 100 is provided downstream, in the sheet feeding direction, of the sheet feeders 230 and the manual feeder 200*b*. The sheet conveyance apparatus 100 is configured to convey the sheet P fed by one of the sheet feeders 230 or the manual feeder 200 to the image forming unit 201B.

The image forming unit 201B is of a four-drum full-color type, and includes a laser scanner 210 and four process cartridges 211. The process cartridges 211 are configured to form toner images of four colors, that is, toner images of yellow (Y), magenta (M), cyan (C), and black (K), respectively. The process cartridges 211 each include a photosensitive drum 212, an electrifier 213 serving as an electrifying portion, a developing unit 214 serving as a developing portion, and a cleaner that is not illustrated and that serves as a cleaning portion. The image forming unit 201B also includes an intermediate transfer unit 201C disposed above the process cartridges 211.

The intermediate transfer unit 201C includes an intermediate transfer belt 216 that is stretched around a driving roller 216*a* and a tension roller 216*b*. The intermediate transfer unit 201C also includes primary transfer rollers 219 disposed inside of the endless intermediate transfer belt 216 and are in contact with the intermediate transfer belt 216 at positions opposing to the respective photosensitive drums 212. The intermediate transfer belt 216 is formed of a film-shaped member and is disposed so as to be in contact with the respective photosensitive drums 212. The driving roller 216*a* is driven by a driving unit not illustrated and causes the intermediate transfer belt 216 to rotate in a direction indicated by an arrow shown in FIG. 1.

The toner images of the respective colors with a negative polarity formed on the photosensitive drums 212 are sequentially superimposed and transferred onto the intermediate transfer belt 216 as a color image by a transfer bias with a positive polarity applied by the primary transfer rollers 219 to the intermediate transfer belt 216. A secondary transfer roller 217 is disposed at a position opposing to the driving roller 216*a* of the intermediate transfer unit 201C. The secondary transfer roller 217 constitutes a secondary transfer portion by which the color image formed on the intermediate transfer belt 216 is transferred onto the sheet P.

Moreover, a fixing unit 220 is disposed above the secondary transfer roller 217, and a pair of first discharge rollers 225*a*, a pair of second discharge rollers 225*b*, and a side reverse portion 201D are disposed at an upper left part of the fixing unit 220. The side reverse portion 201D serves also as a sheet reverse/discharge portion. The side reverse portion 201D includes a reverse roller pair 222, a re-conveyance path R, and so forth. The reverse roller pair 222 is a pair of sheet reverse/conveyance rollers capable of rotating forward and backward. The re-conveyance path R conveys the sheet on which the image has been formed on one surface thereof again to the image forming unit 201B.

The sheet feeders 230 each include a sheet feed cassette 11 and a pickup roller 8. The pickup roller 8 is configured to come into contact with an uppermost sheet P stored in the sheet feed cassette 11 and to rotate to deliver the uppermost sheet out of the cassette 11. Besides a plain sheet of paper, the manual feeder 200 is configured to feed a large-size sheet that cannot be housed in the sheet feed cassettes 11, a highly rigid sheet such as an envelope and a postcard, and a special sheet such as an overhead projector sheet and an embossed sheet of paper. The manual feeder 200 includes a manual feed tray 200*b* on which a sheet is set and a pickup roller 200*a* delivering the sheet on the manual feed tray 200*b*.

The sheet conveyance apparatus 100 includes first, second, and third conveyance paths 101, 104, and 108. The sheet P fed by any of the pickup rollers 8 passes through the first conveyance path 101. The sheet P fed by the pickup roller 200*a* passes through the second conveyance path 104. The first and second conveyance paths 101 and 104 merge together and form the third conveyance path 108.

An image forming operation of the printer 201 will be described in detail next. First, once the image reading unit 202 reads image information on a document, the read image information is converted, after being subjected to image processing, into electrical signals and is transmitted to a laser scanner 210 of the image forming unit 201B. In the image forming unit 201B, the surface of each of the photosensitive drums 212, which has been uniformly electrified by the electrifier 213 to a predetermined polarity and potential, is sequentially exposed to laser light.

Thus, electrostatic latent images of yellow, magenta, cyan, and black are sequentially formed on the photosensitive drums 212 of the respective process cartridges 211. Then, these electrostatic latent images are visualized by being developed with toners of the respective colors, and the primary transfer bias applied to the primary transfer roller 219 causes toner images of the respective colors on the respective photosensitive drums 212 to be sequentially transferred onto the intermediate transfer belt 216 in such a manner that the toner images are superimposed on one another. Thus, a full-color toner image is formed on the intermediate transfer belt 216.

In parallel with this toner image forming operation, the sheet P housed in the sheet feed cassette 11 in one of the sheet feeders 230 is fed by the corresponding pickup roller 8 provided in the sheet feeder 230. The sheet P delivered out of the cassette 11 is separated one by one by a separation portion constituted of a feed roller 9 and a retard roller 10 being in pressure contact with the feed roller 9 and is conveyed to the first conveyance path 101.

The sheet P conveyed to the first conveyance path 101 is conveyed by a conveyance roller pair 109 to the third conveyance path 108, which is formed by the first conveyance path 101 and the second conveyance path 104 merged together. Then, the sheet P is conveyed to a registration roller pair 240 provided along the third conveyance path 108 to correct a skew of the sheet P. In the case of manually feeding the sheet P, the sheet P set on the manual feed tray 200*b* is conveyed to the second conveyance path 104 by the pickup roller 200*a*. The sheet P conveyed to the second conveyance path 104 is conveyed to the third conveyance path 108 and then to the registration roller pair 240 to correct the skew of the sheet.

After the correction of the skew, the sheet P is conveyed to the secondary transfer portion by the registration roller pair 240. At the secondary transfer portion, the secondary transfer bias applied to the secondary transfer roller 217 causes the toner images to be collectively transferred onto the sheet P. Subsequently, the sheet P onto which the toner images have been transferred is conveyed to the fixing unit 220 and is subjected to heat and pressure at the fixing unit 220. As a result, the toners of the respective colors melt and are mixed, and the toner image is fixed to the sheet P as the color image.

Then, the sheet P onto which the toner image has been fixed is discharged to the discharge space S by the first and second discharge roller pairs 225*a* and 225*b* which are provided downstream of the fixing unit 220. The sheets P discharged to the discharge space S is stacked on a supporting portion 223 projecting from a bottom surface of the discharge space S. In the case of forming images on both surfaces of the sheet P, the sheet P is conveyed to the re-conveyance path R by the reverse roller pair 222 after the fixation of the toner image and is then conveyed to the image forming unit 201B again.

Figure 2:
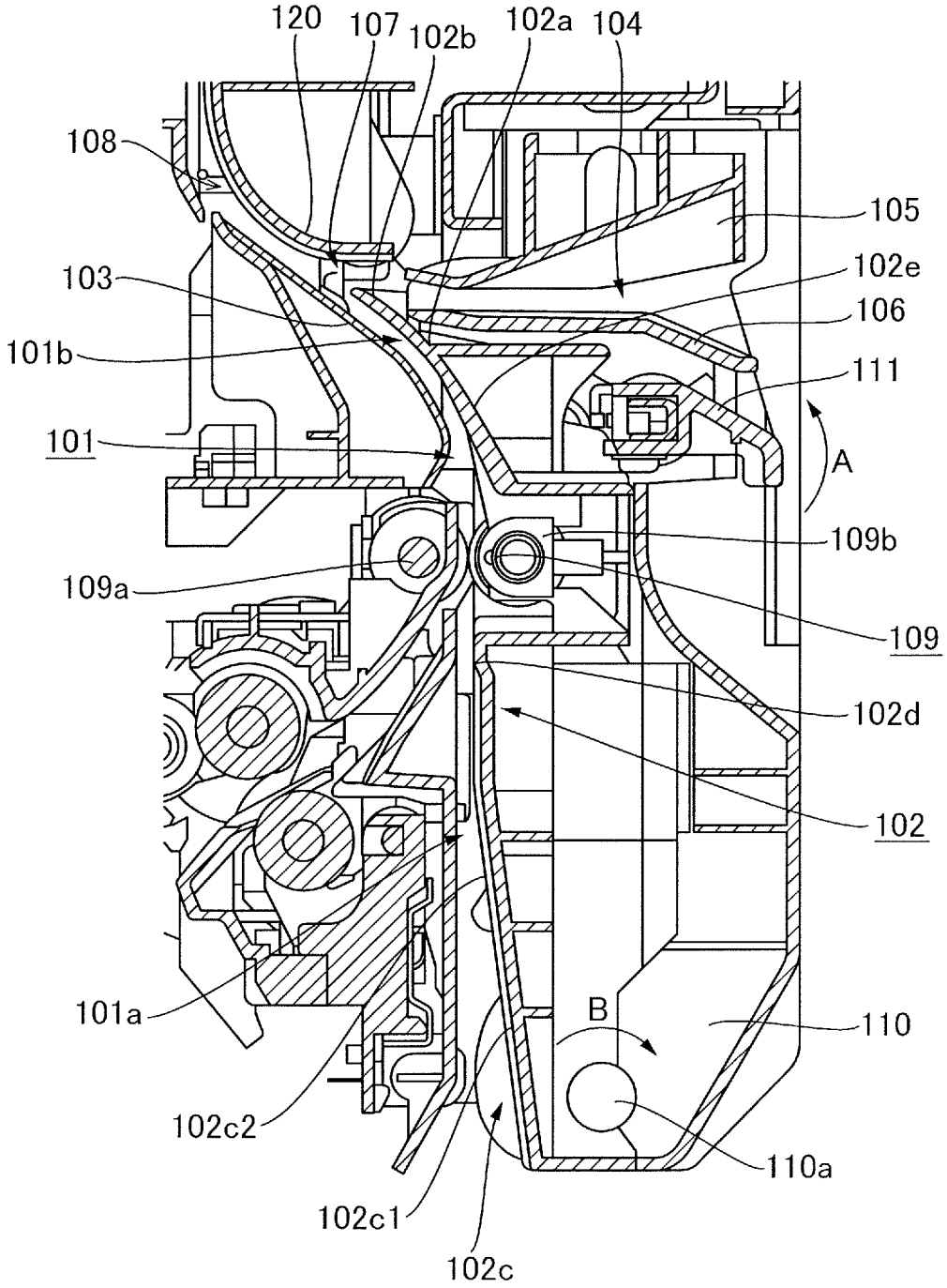
FIG. 2 illustrates configurations of first, second, and third conveyance paths provided in the sheet conveyance apparatus.

Configurations of the first, second, and third conveyance paths 101, 104, and 108 which are provided in the sheet conveyance apparatus 100 of the present exemplary embodiment will be described next with reference to FIG. 2. As illustrated in FIG. 2, a downstream portion in the sheet conveyance direction of the first conveyance path 101, through which the sheet conveyed by any of the sheet feeders 230 passes, is curved. In other words, the first conveyance path 101 includes a straight conveyance path portion 101*a* and a curved conveyance path portion 101*b*.

The curved first conveyance path 101 is formed by outer and inner guides 102 and 103. The outer guide 102 is a second path side guide member formed of resin, curved in a downstream portion thereof in the sheet conveyance direction, and disposed on the second conveyance path side. The inner guide 103 is a guide member disposed so as to oppose to the outer guide 102. In other words, the first conveyance path 101 is formed by the pair of guide members composed of the outer and inner guides 102 and 103.

The second sheet conveyance path 104, through which the sheet conveyed from the manual feed tray 200*b* passes, is formed by an upper guide 105, a lower guide 106, and a distal end portion 102*b* of the outer guide 102. The distal end portion 102*b* is positioned downstream of the lower guide 106 in the sheet conveyance direction. That is, in the present exemplary embodiment, the outer guide 102 is disposed in such a manner that the distal end portion 102*b*, i.e., a downstream end portion of the outer guide 102 in the sheet conveyance direction or a distal end portion of a curved portion of the outer guide 102, forms a downstream portion of the second conveyance path 104 in the sheet conveyance direction. In the case of manually feeding the sheet, the sheet conveyed from the manual feed tray 200*b* passes through the second conveyance path 104 formed by the lower guide 106 and the side of the distal end portion 102*b* of the outer guide 102 and is conveyed to the third conveyance path 108.

The third conveyance path 108, which is formed by the first conveyance path 101 and the second conveyance path 104 merged together at the merging portion 107, is formed by a confluence upper guide 120, a downstream portion in the sheet conveyance direction of the inner guide 103, and so forth.

Meanwhile, a conveyance rib portion 102*c* is formed on a part of the outer guide 102, which is one of the pair of guide members 102 and 103 closer to the second conveyance path 104, the pair of guide members 102 and 103 forming the first conveyance path 101, which is curved. The part on which the conveyance rib portion 102*c* is formed corresponds to the straight conveyance path portion 101*a* of the first conveyance path 101. The conveyance rib portion 102*c* constitutes a straight portion of the outer guide 102 that is provided so as to extend in a straight shape. The conveyance rib portion 102*c* will be described later in detail.

In addition, a smooth portion 102*a* is formed in a part of the outer guide 102 corresponding to the curved conveyance path portion 101*b* of the first conveyance path 101. The smooth portion 102*a* is a curved portion continuous with the conveyance rib portion 102*c* and is provided downstream, in the sheet conveyance direction, of the conveyance rib portion 102*c*. A driven roller 109*b* among driving and driven rollers 109*a* and 109*b* constituting the conveyance roller pair 109 is disposed along the smooth portion 102*a*.

The outer guide 102, the upper guide 105, the lower guide 106, and the driven roller 109*b* are attached to an opening/closing door 110, which is supported by the printer body so as to be capable of being opened and closed by being pivoted on a boss 110*a*. The opening/closing door 110 is provided with a lever 111 that is operated in opening or closing the opening/closing door 110. By providing not the driving roller 109*a* but the driven roller 109*b* on the opening/closing door 110, it becomes possible to reduce the weight of the opening/closing door 110 and thus the opening/closing door 110 becomes easier to operate.

In a case when a jamming or the like occurs in the first, second, or the third conveyance path 101, 104, or 108, the lever 111 is operated to rotate in a direction of an arrow A. This operation unlocks a locking mechanism not illustrated and keeping the opening/closing door 110 at a closing position, and the opening/closing door 110 opens in a direction of an arrow B with respect to the printer body by pivoting on the boss 110*a*. By opening the opening/closing door 110 as described above, the first, second, and third conveyance paths 101, 104, and 108 are exposed, thus enabling to address the jamming or the like.

Figure 3:
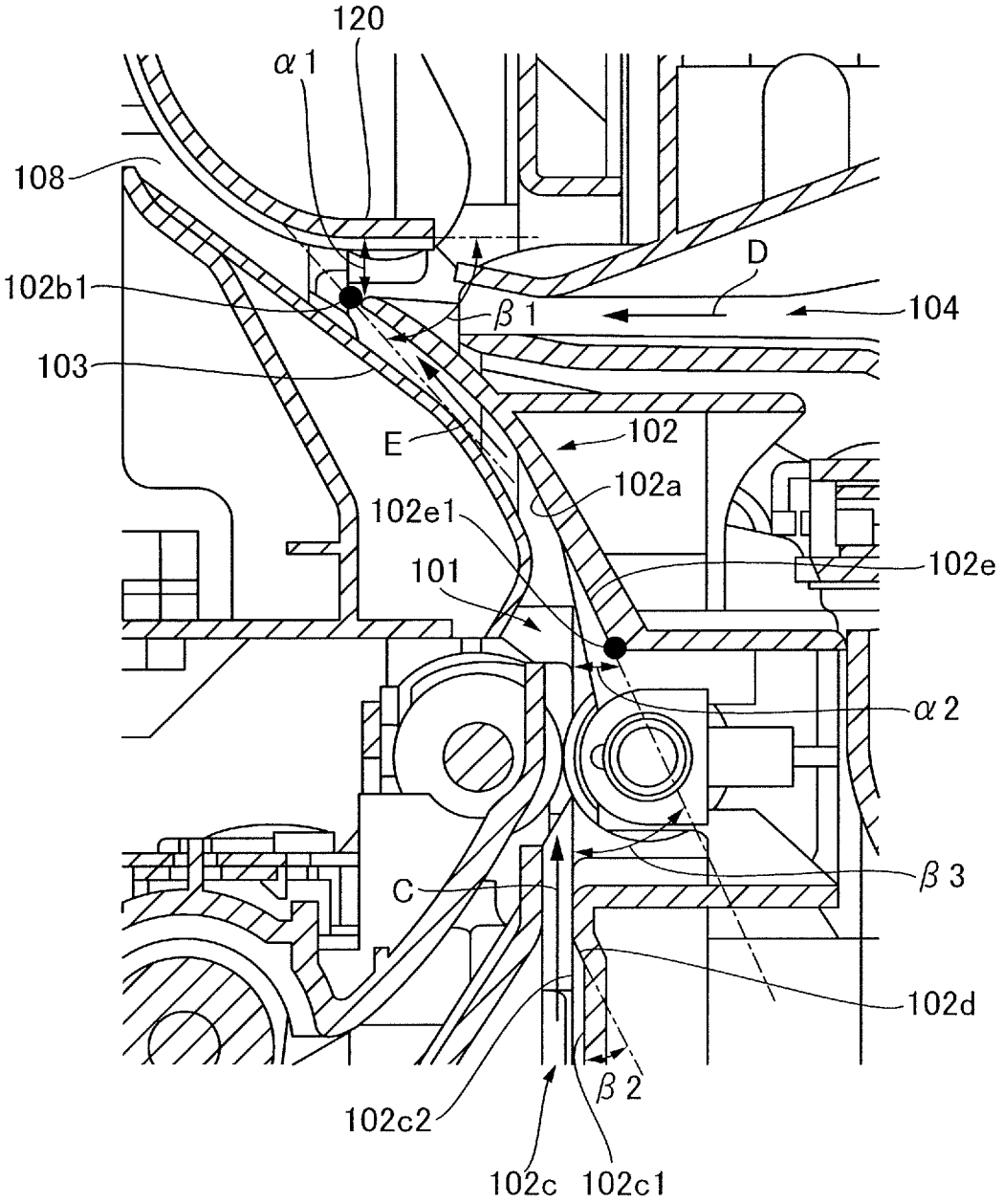
FIG. 3 is an enlarged view of part of the sheet conveyance apparatus.

FIG. 3 is an enlarged view of a part of the sheet conveyance apparatus 100. In FIG. 3, a distance al is a distance between the confluence upper guide 120 and the distal end portion 102*b* of the outer guide 102. The distance al is set to such a value that the confluence upper guide 120 does not interfere with an opening/closing locus of the distal end portion 102*b* of the outer guide 102 in opening the opening/closing door 110. The distance $\alpha 1$ is also set to such a value that the outer guide 102 guides the sheet being conveyed through the second conveyance path 104 in a direction of an arrow D smoothly to the third conveyance path 108 without being caught by the confluence upper guide 120, guided.

The position of a distal end, i.e., the downstream end in the conveyance direction, of the outer guide 102 is set in such a manner that the sheet conveyed through the first conveyance path 101 in a direction of an arrow E can be smoothly passed to the third conveyance path 108. More specifically, the position of the distal end of the outer guide 102 is set in such a manner that an angle $\beta 1$ formed by a straight line and the merging portion guide 120 becomes small. The straight line is a tangent of the inner guide 103 and passes through the vertex 102*b*1 of the distal end portion 102*b* of the outer guide 102. It is then possible to reduce a drag caused in conveying the sheet that is conveyed while abutting its leading edge with the confluence upper guide 120 by setting the position of the distal end of the outer guide 102 such that the angle $\beta 1$ becomes small as described above. In the present exemplary embodiment, the values of $\alpha 1$ and $\beta 1$ are set to $\alpha 1$=3 mm and $\beta 1$=30°, respectively.

As has already been described, the driven roller 109*b* is provided in the outer guide 102. Therefore, for a reason of design such as the disposition of the driven roller 109*b*, the surface of the smooth portion 102*a* of the outer guide 102 partially includes a discontinuous portion in the sheet conveyance direction. Slope portions 102*e* marked with broken lines in FIG. 4, which is a perspective view of the outer guide 102, each represent the discontinuous portion of the smooth portion 102*a*. It is noted that while the slope portions 102*e* each include a rib structure formed thereon, the rib structure does not abut with the sheet passing by the smooth portion 102*a* in a normal situation.

Here, as illustrated in FIG. 3 that has been already described, a distance $\alpha 2$ is set between the surface of the smooth portion 102*a* and an inflection point 102*e*1 of each of the slope portions 102*e* such that the leading end of the sheet is not caught by the discontinuous portion of the smooth portion 102*a*. In addition, an angle $\beta 3$ of each of the slope portions 102*e* with respect to the sheet conveyance direction, i.e., a direction of an arrow C, is set such that the drag in conveying the sheet is minimized. In the present exemplary embodiment, the values of $\alpha 2$ and $\beta 3$ are set to $\alpha 2$=3 mm and $\beta 3$=25°, respectively.

Figure 4:
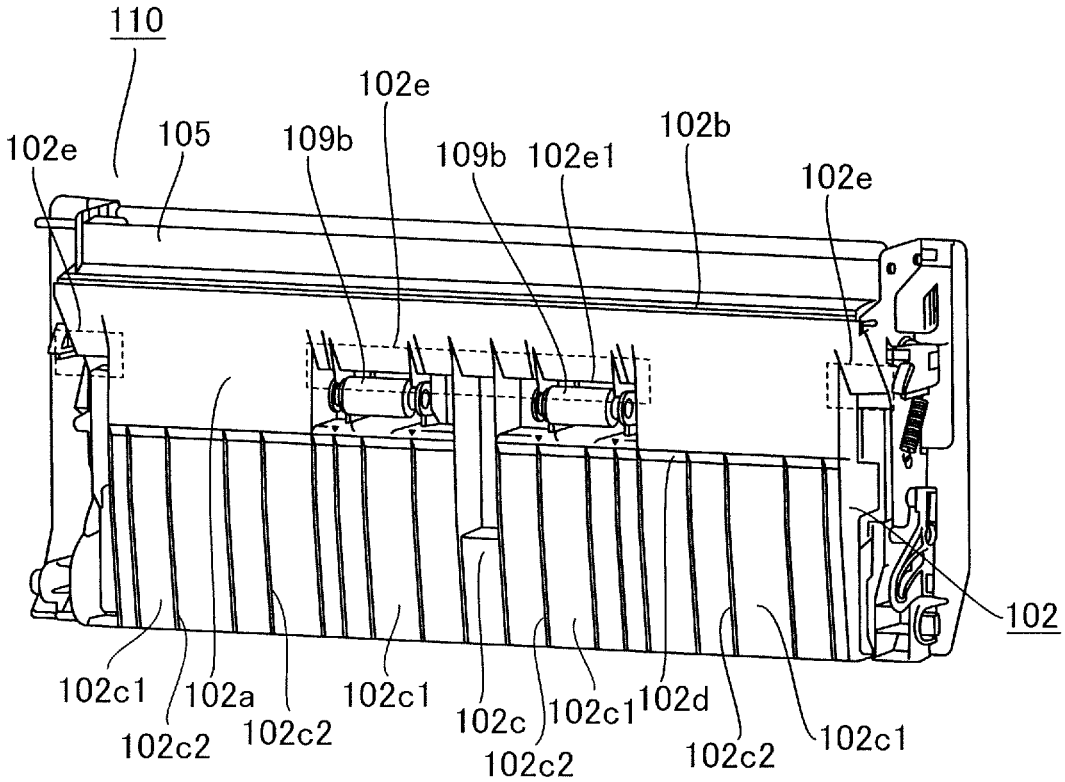
FIG. 4 is a perspective view of an outer guide member forming the first conveyance path.

Meanwhile, in the present exemplary embodiment, the conveyance rib portion 102*c*, i.e., the straight portion of the outer guide 102, is provided with ribs. A configuration of the conveyance rib portion 102*c* of the outer guide 102 will be described next with reference to FIGS. 3 and 4. As illustrated in FIGS. 3 and 4, the conveyance rib portion 102*c* includes a base surface 102*c*1 and a plurality of conveyance ribs 102*c*2. The base surface 102*c*1 is a base portion, and the conveyance ribs 102c2 are provided on the base surface 102c1 so as to project perpendicularly from the base surface 102c1 and to be parallel to the sheet conveyance direction. The conveyance ribs 102c2 project to such a height that the ridges of the conveyance ribs 102c2 are continuous with the surface of the smooth portion 102a. In addition, a slope portion 102d is formed between each pair of the conveyance ribs 102c2 adjacent to each other in a width direction orthogonal to the sheet conveyance direction. The slope portion 102d is inclined from the base surface 102c1 toward the ridges of the conveyance ribs 102c2. In other words, the slope portion 102d is inclined in such a manner that the slope portion 102d approaches from the base surface 102c1, i.e. the base portion, to the ridges of the conveyance ribs 102c as it approaches the downstream side in the sheet conveyance direction. The slope portion 102d includes an inclined surface that continuously connects to the surface of the smooth portion 102a, i.e., the curved portion.

In the case where the conveyance ribs 102c2 are provided in the conveyance rib portion 102c, a leading corner portion of a sheet moving along the conveyance rib portion 102c may sometimes get into a space between the conveyance ribs 102c2. However, even if the leading corner portion of the sheet gets into the space between the conveyance ribs 102c2, the leading corner portion of the sheet abuts with the slope portion 102d. Then, if the sheet is conveyed further, the leading corner portion of the sheet will be conveyed to the smooth portion 102a along the slope of the slope portion 102d.

As described above, with the slope portion 102d formed between the pair of the conveyance ribs 102c2 adjacent to each other, it is possible to convey the sheet to the smooth portion 102a even if the leading corner portion of the sheet gets into a space between the pair of the conveyance ribs 102c2. The slope portion 102d is inclined by an inclination angle β2 of such a value that the leading corner portion of the sheet can pass by the slope portion 102d without being caught by the slope portion 102d. The inclination angle β2 is set in a predetermined range for smoothly conveying the sheet. In the present exemplary embodiment, the inclination angle β2 is set to β2=25°.

Figure 5A:
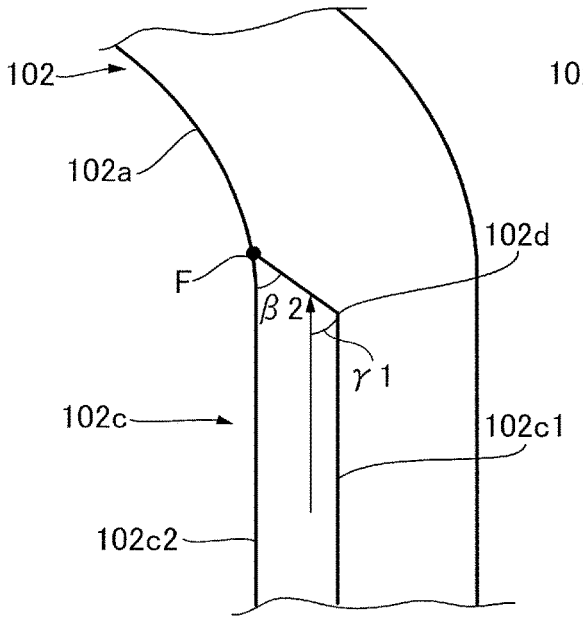
FIG. 5A illustrates a state in which conveyance ribs are provided in a conveyance rib portion of the outer guide member.

In the present exemplary embodiment, as illustrated in FIG. 5A, downstream ends in the sheet conveyance direction of the slope portions 102d inclined toward the ridges of the conveyance ribs 102c2 coincide with a border portion F between the conveyance rib portion 102c and the smooth portion 102a. Thus, the base surface 102c1 of the conveyance rib portion 102c and the smooth portion 102a are connected by the slope portions 102d.

In the case where the downstream ends of the slope portions 102d in the sheet conveyance direction are provided so as to coincide with the border portion F between the conveyance rib portion 102c and the smooth portion 102a, it is possible to extend the conveyance ribs 102c2 to the border portion F between the conveyance rib portion 102c and the smooth portion 102a. It is noted that this border portion F approximately coincides with a border portion between the straight conveyance path portion 101a and the curved conveyance path portion 101b of the first conveyance path 101. By providing the conveyance ribs 102c2 so as to extend to the border portion F between the conveyance rib portion 102c and the smooth portion 102a as described above, it becomes possible to increase the length of the conveyance ribs 102c2, and thus the frictional drag applied to the sheet when the sheet passes through the straight conveyance path portion 101a can be reduced. This allows stably conveying the sheet to the curved conveyance path portion 101b.

Figure 5B:
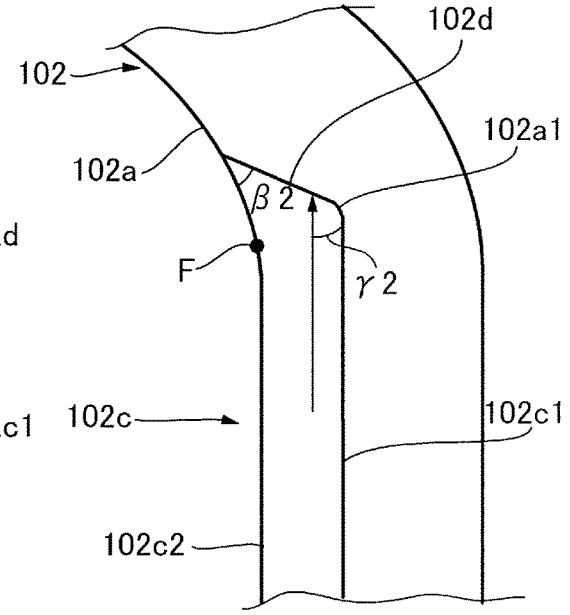
FIG. 5B illustrates a state in which the conveyance ribs are provided in a smooth portion of the outer guide member.

Meanwhile, in the case where the downstream ends, in the sheet conveyance direction, of the slope portions 102d are provided so as to coincide with the border portion F, the leading corner portion of the sheet having gotten into the space between the conveyance ribs 102c2 abuts one of the slope portions 102d in an abutting angle of γ1=β2 as illustrated in FIG. 5A. In contrast, in the case where the conveyance ribs 102c2 are provided so as to extend to the smooth portion 102a, the leading corner portion of the sheet having gotten into the space between the conveyance ribs 102c2 abuts one of the slope portion 102d in an abutting angle of γ2 as illustrated in FIG. 5B.

In the case where the conveyance ribs 102c2 are extended to the smooth portion 102a, the slope portions 102d are positioned downstream, in the sheet conveyance direction, of the border portion F between the conveyance rib portion 102c and the smooth portion 102a. It is noted that in the case where the conveyance ribs 102c2 are extended to the smooth portion 102a, the conveyance ribs 102c2 are provided so as to project perpendicularly from a curved base surface 102a1 of the smooth portion 102a as illustrated in FIG. 5B.

As described above, in the case where the conveyance ribs 102c2 are formed on the curved base surface 102a1 with the inclination angle of β2, the abutting angle γ2 with the leading corner portion of the sheet becomes larger than the abutting angle γ1 shown in FIG. 5A. If the abutting angle γ2 increases, the sheet becomes more likely to be caught by the slope portions 102d and thus conveyance malfunction becomes more likely to occur. That is, in the case where the ribs are provided in the smooth portion 102a, it becomes difficult to stably convey the sheet.

Therefore, the conveyance ribs 102c2 are provided in the conveyance rib portion 102c so as to extend to the border portion F between the conveyance rib portion 102c and the smooth portion 102a, and no rib is provided in the smooth portion 102a. It is noted that in the present exemplary embodiment, since the rib structure is formed on each of the slope portions 102e as illustrated in FIG. 4 described above, no rib is provided at least in at least a side region in the conveyance rib portion 102c. The side region is a region beside the driven rollers 109b in the width direction of the driven rollers 109b.

In the case where the conveyance ribs 102c2 are provided in the conveyance rib portion 102c and no rib is provided in the smooth portion 102a, it becomes possible to reduce a thickness of the distal end portion 102b of the outer guide 102 positioned at the merging portion 107 of the first conveyance path 101 and the second conveyance path 104. This allows minimizing the space at the merging portion 107 and thus prevents the printer body, which also serves as the body of the sheet conveyance apparatus, from being enlarged. Moreover, by forming the ribs in the conveyance rib portion 102c, i.e., the straight portion, to reduce the thickness of the distal end portion 102b of the outer guide 102, it becomes possible to position the vertex 102b1 of the distal end portion 102b of the outer guide 102 at a downstream position in the sheet conveyance direction in the merging portion 107. This allows stably passing on the sheet conveyed through the curved first conveyance path 101 to the third conveyance path 108 without being caught or the like.

As described above, according to the present exemplary embodiment, it becomes possible to reduce the thickness of the distal end portion 102b of the outer guide 102 positioned at the merging portion 107 of the first conveyance path 101 and the second conveyance path 104 by providing the conveyance ribs 102*c*2 in the conveyance rib portion 102*c*. This allows stably conveying the sheet without enlarging the size of the apparatus.

Although the case where the conveyance ribs 102*c*2 are provided so as to extend to the border portion F of the outer guide 102 between the conveyance rib portion 102*c* and the smooth portion 102*a* has been described above, the embodiment of the present invention is not limited to this exemplary embodiment. For instance, the conveyance ribs 102*c*2 may be provided so as to extend not to the border portion F of the outer guide 102 but to a position upstream, in the sheet conveyance direction, of the border portion F as long as it is possible to stably convey the sheet to the curved conveyance path portion 101*b* through the straight conveyance path portion 101*a*.

Moreover, although the case where the present invention is applied to the merging portion of the first and second conveyance paths 101 and 104 has been described above, the present invention is not limited to this, and the present invention may be also applied to a merging portion of the third conveyance path 108 and the re-conveyance path R.

OTHER EMBODIMENTS

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment of the present invention, and by a method performed by the computer of the system or apparatus by, for example, reading out and executing the computer executable instructions from the storage medium to perform the functions of one or more of the above-described embodiment. The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-176458, filed Sep. 8, 2015 which is hereby incorporated by reference herein in its entirety.

What is claimed is:

1. A sheet conveyance apparatus comprising:

a first conveyance path whose downstream portion in a sheet conveyance direction is curved;

a second conveyance path configured to merge with the first conveyance path at a merging portion; and a second path side guide member disposed on a side of the second conveyance path among guide members configured to form the first conveyance path, wherein the second path side guide member comprises a downstream end portion, in the sheet conveyance direction, positioned at a merging portion, a curved portion provided upstream, in the sheet conveyance direction, of the downstream end portion, and a straight portion provided upstream, in the sheet conveyance direction, of the curved portion and extending straightly so as to be continuous with the curved portion, with the downstream end portion, the curved portion, and the straight portion formed as one piece, the straight portion comprises a plurality of ribs, a base portion, and a slope portion, the plurality of ribs projecting from the base portion and being parallel to the sheet conveyance direction, the slope portion being provided between two of the plurality of ribs adjacent to each other in a width direction orthogonal to the sheet conveyance direction and being inclined in such a manner that the slope portion approaches from the base portion to ridges of the ribs as it approaches the downstream side in the sheet conveyance direction, the curved portion and the downstream end portion comprise smooth surfaces, a first surface of the downstream end portion of the second path side guide member is configured to form the first conveyance path in the merging portion and a second surface, oppositely arranged to the first surface, of the downstream end portion of the second path side member is configured to form the second conveyance path in the merging portion, and no rib is provided on the downstream end portion.

2. The sheet conveyance apparatus according to claim 1, wherein the plurality of ribs are provided so as to extend to a border portion between the straight portion and the curved portion of the second path side guide member.

3. The sheet conveyance apparatus according to claim 1, wherein the plurality of ribs are provided so as to extend to a position upstream, in the sheet conveyance direction, of a border portion between the straight portion and the curved portion of the second path side guide member.

4. The sheet conveyance apparatus according to claim 1, wherein the plurality of ribs are provided so as to project from the base portion to such a height that the ridges of the plurality of ribs are continuous with a surface of the curved portion.

5. The sheet conveyance apparatus according to claim 1, further comprising:

a third conveyance path formed by merging the first and second conveyance paths; and a conveyance roller pair disposed along the first conveyance path and configured to convey a sheet passing through the first conveyance path to the third conveyance path, wherein a driven roller constituting the conveyance roller pair is provided in the curved portion of the second path side guide member.

6. The sheet conveyance apparatus according to claim 5, wherein no rib is provided at least in a side region in the second path side guide member, the side region being a region beside the driven roller in a width direction of the driven roller.

7. The sheet conveyance apparatus according to claim 1, wherein no rib is provided on the smooth surfaces and each of the smooth surfaces has a length longer than that of a sheet having a minimum standard size in a width direction.

8. The sheet conveyance apparatus according to claim 1, wherein the slope portion comprises an inclined surface continuously connected to a surface of the curved portion.

9. The sheet conveyance apparatus according to claim 1, further comprising:

an apparatus body; and a door that is openable and closable with respect to the apparatus body, wherein the second path side guide member is provided on the door.

10. The sheet conveyance apparatus according to claim 1, further comprising:

a third conveyance path formed by merging the first and second conveyance path, wherein the second path side guide member comprises a conveyance roller disposed on the downstream of the slope portion in the sheet conveyance direction and configured to convey a sheet passing through the first conveyance path to the third conveyance path.

11. The sheet conveyance apparatus according to claim 1, further comprising a first path side guide member disposed on a side of the first conveyance path among the guide members configured to form the second conveyance path, wherein the first path side guide member and the second path side guide member are formed by different pieces, and the second conveyance path is formed such that a portion formed by the second surface of the downstream end portion is arranged downstream of a portion formed by the first side guide member in the sheet conveyance direction.

12. An image forming apparatus comprising:

an image forming unit configured to form an image on a sheet; and a sheet conveyance apparatus configured to convey a sheet to the image forming unit, the sheet conveyance apparatus comprising:

a first conveyance path whose downstream portion in a sheet conveyance direction is curved;

a second conveyance path configured to merge with the first conveyance path at a merging portion; and a second path side guide member disposed on a side of the second conveyance path among guide members configured to form the first conveyance path, wherein the second path side guide member comprises a downstream end portion, in the sheet conveyance direction, positioned at the merging portion, a curved portion provided upstream, in the sheet conveyance direction, of the downstream end portion, and a straight portion provided upstream, in the sheet conveyance direction, of the curved portion and extending straight so as to be continuous with the curved portion, with the downstream end portion, the curved portion, and the straight portion formed as one piece, the straight portion comprises a plurality of ribs, a base portion, and a slope portion, the plurality of ribs projecting from the base portion and being parallel to the sheet conveyance direction, the slope portion being provided between two of the plurality of ribs adjacent to each other in a width direction orthogonal to the sheet conveyance direction and being inclined in such a manner that the slope portion approaches from the base portion to ridges of the ribs as it approaches the downstream side in the sheet conveyance direction, the curved portion and the downstream end portion comprise smooth surfaces, a first surface of the downstream end portion of the second path side guide member is configured to form the first conveyance path in the merging portion and a second surface, oppositely arranged to the first surface, of the downstream end portion of the second path side member is configured to form the second conveyance path in the merging portion, and no rib is provided on the downstream end portion.

* * * * *